US006023189A

United States Patent [19]

Seelbach

[11] Patent Number: 6,023,189

[45] **Date of Patent: *Feb. 8, 2000**

[54] CMOS CIRCUIT FOR PROVIDING A BANDCAP REFERENCE VOLTAGE

[75] Inventor: Walter C. Seelbach, Fountain Hills, Ariz.

[73] Assignee: Motorola, Inc., Schaumburg, Ill.

[ * ] Notice: Under 35 U.S.C. 154(b), the term of this patent shall be extended for 670 days.

[21] Appl. No.: 08/650,023

[22] Filed: May 17, 1996

Related U.S. Application Data

[63] Continuation of application No. 08/301,093, Sep. 6, 1994, abandoned.

[51] Int. Cl.[7] ..... G05F 3/02

[52] U.S. Cl. ..... 327/538; 327/543

[58] Field of Search ..... 327/513, 538, 327/539, 540, 541, 543, 545, 546; 323/313

[56] References Cited

U.S. PATENT DOCUMENTS

| | | | |
|---|---|---|---|
| 4,896,094 | 1/1990 | Greaves et al. | 327/513 |
| 5,061,862 | 10/1991 | Tamagawa | 327/541 |
| 5,081,410 | 1/1992 | Wood | 327/530 |
| 5,087,830 | 2/1992 | Cave et al. | 327/539 |
| 5,153,500 | 10/1992 | Yamamoto et al. | 327/542 |
| 5,245,273 | 9/1993 | Greaves et al. | 327/540 |
| 5,384,740 | 1/1995 | Etoh et al. | 327/543 |

OTHER PUBLICATIONS

IEEE Journal of Solid–State Circuits, vol. sc–18, No. 6, "A precision Curvature–Comensated CMOS Bandgap Reference", Dec. 1983.

IEE Journal of Solid–State Circuits, vol. sc–20, No. 6, "CMOS Voltage References Using Lateral Bipolar Transistors", Dec. 1985.

IEEE Journal of Solid–State Circuits, vol. sc–19, No. 6, "A Programmable CMOS Dual Channel Interface Processor for Telecommunications Applications", Dec. 1984.

IEEE Journal of Solid–State Circuits, vol. sc–14, No. 3, "A low–Voltage CMOS Bandgap Reference", Jun. 1979.

IEEE Journal of Solid–State Circuits, vol. 24, No. 3, "A Floating CMOS Bandgap Voltage Reference for Differential Applications", Jun. 1989.

IEEE Journal of Solid–State Circuits, vol. sc–13, No. 6, "A New NMOS Temperaure–Stable Voltage Referrence", Dec. 1978.

*Primary Examiner*—Terry D. Cunningham
*Attorney, Agent, or Firm*—Rennie W. Dover

[57] ABSTRACT

A low voltage submicron CMOS circuit (10) for providing an output bandgap voltage ($V_{BG}$) that is substantially independent of temperature and power supply variations has been provided. The CMOS circuit utilizes parasitic transistors (28–30) to create a delta voltage that has a positive temperature coefficient across a differential pair of NMOS transistors (14, 16). This delta voltage is then converted into differential currents which are amplified and mirrored and summed together to provide an output current ($I_O$) that has a positive temperature coefficient. This output current is then passed through a series network including a resistor element (52) and a parasitic PNP junction transistor (31) to provide a bandgap voltage of 1.2 volts wherein the voltage across the resistor element has a positive temperature coefficient and the voltage across the parasitic PNP junction transistor has an inherent negative temperature coefficient.

5 Claims, 1 Drawing Sheet

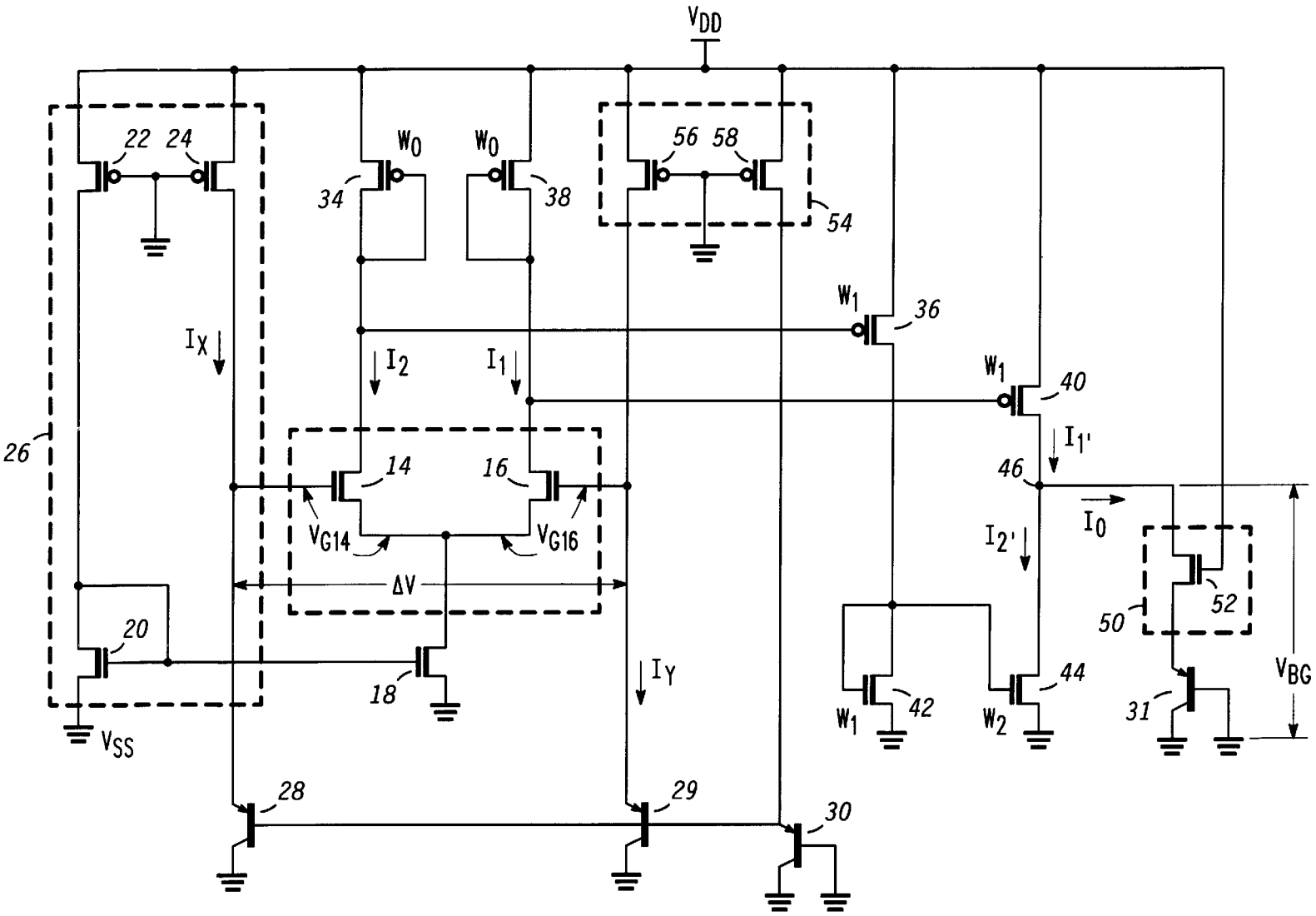
VBG
52
31
50
I0
40
I1'
44
46
I2'
W1
W2
36
42
W1
W1
54
30
VDD
58
56
29
IY
38
W0
I1
16
VG16
W0
I2
14
ΔV
18
34
VG14
28
IX
24
22
20
VSS
26

CM OS CIRCUIT FOR PROVIDING A BANDCAP REFERENCE VOLTAGE

This application is a continuation of prior application Ser. No. 08/301,093, filed Sep. 6, 1994, now abandoned.

FIELD OF THE INVENTION

This invention relates to voltage reference circuits and, in particular, to a low voltage submicron CMOS circuit for providing a bandgap voltage that is referenced to a power supply terminal.

BACKGROUND OF THE INVENTION

Bandgap voltage reference circuits are well known and widely used in the art for providing an output voltage of 1.2 volts or greater that is substantially independent of temperature. The output voltage has a substantially zero temperature coefficient and is produced by summing together two voltages such that one of the voltages has a positive temperature coefficient while the other has a negative temperature coefficient.

Typically, the positive temperature coefficient is produced by using first and second bipolar transistors operating at different current densities such that the first bipolar transistor is operating at a lower current density than the second bipolar transistor. This amplified positive temperature coefficient voltage is then combined in series with the $V_{BE}$ voltage of a third bipolar transistor which inherently has a negative temperature coefficient such that a composite output voltage having a very low or substantially zero temperature coefficient is provided.

It would desirable to provide a bandgap voltage in low voltage submicron CMOS technology. However, most CMOS bandgap circuits are manufactured utilizing 5 volt CMOS technology. Moreover, many bandgap circuits provide a differential bandgap reference voltage that is not referenced to any power supply rail. However, in particular applications, such as low voltage submicron CMOS applications, it is desirable to provide a bandgap reference voltage that will operate at reduced power supply voltages and can be referenced to a power supply terminal.

Hence, there exists a need for an improved bandgap circuit utilizing low voltage submicron CMOS technology for providing a bandgap voltage referenced to a power supply terminal.

BRIEF DESCRIPTION OF THE DRAWING

The sole FIGURE is a detailed schematic diagram of a CMOS circuit for providing a bandgap voltage that is referenced to a power supply terminal.

DETAILED DESCRIPTION OF THE DRAWING

Referring to the sole figure, there is illustrated CMOS circuit 10 for providing output voltage $V_{BG}$ that is a bandgap voltage (1.2 volts) which is substantially independent of temperature and power supply variations. CMOS circuit 10 is designed with an eye toward low voltage (3.3 volts) submicron CMOS technology but it should be understood that circuit 10 may also be applicable to higher voltage (5 volt) CMOS technology.

CMOS circuit 10 includes a differential pair of MOS transistors as represented by box 12 which includes NMOS transistors 14 and 16. The source electrodes of transistors 14 and 16 are coupled through current source transistor 18 to a first supply voltage terminal at which the operating potential $V_{SS}$ is applied. In a preferred embodiment, operating potential $V_{SS}$ is ground potential.

Transistor 18 has a drain electrode coupled to the common source electrodes of transistors 14 and 16, and a source electrode returned to ground. The control/gate electrode of transistor 18 is coupled to the gate and drain electrodes of NMOS transistor 20 wherein NMOS transistor 20 and PMOS transistors 22 and 24 comprise bias circuit 26.

The source electrode of transistor 20 is returned to ground. The drain electrode of transistor 20 is coupled to the drain electrode of transistor 22 the latter having a gate electrode returned to ground and coupled to the control electrode of transistor 24. The source electrodes of transistors 22 and 24 are coupled to a second supply voltage terminal at which the operating potential $V_{DD}$ is applied. The drain electrode of transistor 24 is coupled to the control electrode of NMOS transistor 14.

Transistors 28 through 31 are parasitic PNP transistors of a CMOS process wherein the collector of each parasitic transistor takes the form of the P-substrate of the N-well CMOS process, each base takes the form of an N-well region, and each emitter takes the form of the P+ source/drain implant region of a PMOS transistor. Moreover, it is worth noting that although transistors 28–31 are parasitic PNP transistors that are typically available in a P-type substrate CMOS process, if an N-type substrate CMOS process were utilized, then transistors 28–31 would equivalently be parasitic NPN transistors.

In particular, parasitic transistor 28 has an emitter coupled to the control electrode of transistor 14 while the emitter of parasitic transistor 29 is coupled to the control electrode of transistor 16. The bases of parasitic transistors 28 and 29 are coupled to the emitter of parasitic transistor 30 the latter having a base returned to ground. The collectors of parasitic transistors 28–30 are also returned to ground.

The drain electrode of NMOS transistor 14 is coupled to the drain and gate electrodes of PMOS transistor 34 and to the gate electrode of PMOS transistor 36. The source electrodes of PMOS transistors 34 and 36 are coupled to receive operating potential $V_{DD}$.

The drain electrode of NMOS transistor 16 is coupled to the drain and control electrodes of PMOS transistor 38 and to the control electrode of PMOS transistor 40. The source electrodes of PMOS transistors 38 and 40 are coupled to receive operating potential $V_{DD}$.

The drain electrode of PMOS transistor 36 is coupled to the drain and control electrodes of NMOS transistor 42 and to the control electrode of NMOS transistor 44. The source electrodes of NMOS transistors 42 and 44 are returned to ground.

The drain electrodes of transistors 40 and 44 are coupled together at summing node 46 wherein output voltage $V_{BG}$ is provided at summing node 46.

Resistor element 50 is coupled between summing node 46 and the emitter of parasitic PNP transistor 31 the latter having its base and collector returned to ground thereby forming a junction diode.

Resistor element 50 includes NMOS transistor 52 having a drain electrode coupled to summing node 46 and a source electrode coupled to the emitter of parasitic PNP transistor 31. The control electrode of transistor 52 is coupled to receive operating potential $V_{DD}$.

CMOS circuit 10 further includes bias circuit 54 which includes PMOS transistors 56 and 58 each having its source electrode coupled to receive operating potential $V_{DD}$ and their control electrodes returned to ground. The drain electrode of PMOS transistor 56 is coupled to the control electrode of NMOS transistor 16 while the drain electrode of PMOS transistor 58 is coupled to the emitter of parasitic transistor 30.

In operation, transistors 28–29 are appropriately sized so as to provide a delta voltage (ΔV) between the control electrodes of transistors 14 and 16. Moreover, transistors 28–30 provide an appropriate voltage to the control electrodes of transistors 14 and 16 so as to allow the transistors to operate in a normal mode. In particular, the delta voltage (ΔV) appearing across the control electrodes of transistors 14 and 16 can be represented as shown in EQN. 1.

$$\Delta V = V_{G16} - V_{G14} \qquad \text{EQN. 1}$$

where $V_{G14}$, $V_{G16}$ are the gate to source voltages of NMOS transistors 14 and 16, respectively.

Also, ΔV may be expressed as a logarithmic function of the currents flowing through transistors 14 and 16 as shown in EQN. 2.

$$\Delta V = \frac{kT}{q}\mathrm{Ln}\left[\frac{mI_y}{I_x}\right] \qquad \text{EQN. 2}$$

where

KT/q represents the thermal voltage of a silicon junction;

$I_x$, $I_y$ are the currents flowing through PNP transistors 28 and 29, respectively; and m is a multiple that the emitter area of transistor 28 is with respect to transistor 29, i.e., $A_{E28} = m^* A_{E29}$.

Thus, from EQN. 2 it is clear that the ΔV that is generated between the control electrodes of transistors 14 and 16 has a positive temperature coefficient since it is a function of the term kT/q.

One can also express the current $I_1$ which is the current flowing through NMOS transistor 16 as shown in EQN 3.

$$I_1 = \beta_1(\Delta V + V_{G14} - V_T)^2 \qquad \text{EQN. 3}$$

where $V_T$ is the NMOS threshold voltage of transistors 14 and 16; and $\beta_1$ is the gain of transistors 14 and 16 which is a function of the ratio of the width and length (W/L) of the transistors, mobility ($\mu$) and unit gate capacitance ($C_O$).

Similarly, the current $I_2$ which is the current flowing through NMOS transistor 14 can be represented as shown in EQN. 4.

$$I_2 = \beta_1(V_{G14} - V_T)^2 \qquad \text{EQN. 4}$$

Referring back to the sole figure, current $I_2$ (the current flowing through transistor 14) is mirrored through transistors 34, 36, 42 and 44 thereby providing current $I_2'$ flowing through NMOS transistor 44. Similarly, current $I_1$ (the current flowing through transistor 16) is mirrored through transistors 38 and 40 to provide current $I_1'$ flowing through transistor 40.

Currents $I_1'$ and $I_2'$ are amplified versions of currents $I_1$ and $I_2$, respectively, by adjusting the widths of current mirror transistors 34, 36, 42, 44, 38 and 40. For example, in a preferred embodiment, suppose that the widths of current mirror transistors 34 and 38 have a width as denoted by $W_0$ while current mirror transistors 36, 40 and 42 have a width as denoted by $W_1$. Also, suppose that the width of transistor 44 has a width of $W_2$.

Using these widths for the current mirror transistors and the EQNs. 1–4, one can obtain an expression for the output current $I_O$ that flows out of summing node 46 and through resistor 50 and transistor 31 as shown in EQNs. 5A and 5B. Thus, bias circuits 26 and 54, transistors 14, 16, 34, 38, 36, 40, 42, and 44, and parasitic transistors 28, 29, and 30 cooperate to form a CMOS circuit for providing a current having a positive temperature coefficient.

$$I_0 = \frac{W_1 I_1 - W_2 I_2}{W_0} \qquad \text{EQN. 5A}$$

$$I_0 = \frac{W_1}{W_0} 2\beta_1(V_{G14} - V_T)\Delta V + \beta_1(V_{G14} - V_T)^2\left[\frac{W_1 - W_2}{W_0}\right] + \frac{W_1}{W_0}\beta_1 \Delta V^2 \qquad \text{EQN. 5B}$$

As can be seen from EQN. 5B, the first term represents a term that has a positive temperature coefficient since it includes the term ΔV. The second term is a DC error term which can be made negligible by appropriately choosing the width $W_2$ of transistors 44. Also, the third term is a second order error term which can also be made small by setting $2(V_{G14} - V_T) > \Delta V$.

Since resistor 50 is an NMOS transistor, its resistance value is simply the inverse of its transconductance or can be more appropriately expressed as shown in EQN. 6.

$$R = \frac{1}{2\beta_2(V_{DD} - V_{BE31} - V_T)}.$$

where $\beta_2$ is the gain of transistor 52;

Output voltage $V_{BG}$ is then equal to current $I_O$ multiplied by resistor R plus an emitter voltage appearing across transistor 31 which can be expressed as shown in EQN. 7.

$$V_{BG} \approx \frac{\beta_1 W_1 \Delta V}{\beta_2 W_0} + \Phi_E.$$

where $\Phi_E$ is the base emitter voltage of transistor 31.

From EQN. 7, it can be seen that the output voltage appearing at circuit node 46 is a combination of two terms. The first term, which includes the ΔV expression, has a positive temperature coefficient since ΔV was a function of KT/q as shown in EQN. 2. The second term ($\Phi_E$), which is the base emitter voltage appearing across transistor 31, has a negative temperature coefficient as is well known for bipolar junction transistors. Thus, by appropriately choosing the values of $\beta_1$ and $\beta_2$ and $W_1$ and $W_0$, the positive temperature coefficient of the first term can be made substantially equal to the negative temperature coefficient of the second term thereby resulting in an output bandgap voltage $V_{BG}$ that is substantially independent of temperature variations.

Moreover, by using NMOS transistor 52 to function as a resistor, output voltage $V_{BG}$ can be made to be substantially independent of power supply variations because the resistance value of NMOS transistor 52 is a function of operating potential $V_{DD}$ as shown in EQN. 6. In particular, it has been shown that by adjusting the width of transistor 52, one can fine tune the positive temperature coefficient while adjusting the width of transistor 44 will provide optimum power supply rejection. Thus, output $V_{BG}$ can be made to be substantially independent of temperature as well as power supply variations and is referenced with respect to operating potential $V_{SS}$ (ground reference).

Thus, the present invention utilizes CMOS technology to provide an output bandgap voltage that is substantially independent of temperature and power supply variations and is referenced to a power supply terminal.

By now it should be apparent from the foregoing discussion that a novel CMOS circuit for providing an output bandgap voltage that is substantially independent of temperature and power supply variations has been provided. The CMOS circuit utilizes parasitic transistors to create a delta voltage that has a positive temperature coefficient across a differential pair of NMOS transistors. This delta voltage is then converted into differential currents which are amplified and mirrored and summed together to provide an output current that has a positive temperature coefficient. This output current is then passed through a series network including a resistor element and a parasitic PNP junction transistor to provide a bandgap voltage wherein the voltage across the resistor element has a positive temperature coefficient and the voltage across the parasitic PNP junction transistor has an inherent negative temperature coefficient.

While the invention has been described in specific embodiments thereof it is evident that many alterations, modifications and variations will be apparent to those skilled in the art. Accordingly, it is intended to embrace such alterations, modifications and variations in the appended claims.

What is claimed is:

1. A CMOS circuit for providing a current having a positive temperature coefficient, the circuit comprising:

CMOS parasitic P-N junction means for generating a delta voltage having a positive temperature coefficient;

CMOS differential amplifying means responsive to said delta voltage for providing differential currents; and summing means responsive to said differential currents for providing a resulting current at an output of said summing means, said current having a positive temperature coefficient, and a feedback connection absent between said output of said summing means and said CMOS parasitic P-N junction means.

2. A method for providing an output current at an output node of a circuit manufactured using CMOS technology, the output current having a positive temperature coefficient, the method comprising the steps of:

generating a delta voltage having a positive temperature coefficient without using feedback from the output node;

converting said delta voltage to differential currents;

amplifying and mirroring said differential currents; and summing said amplified and mirrored differential currents to provide the resulting output current from the output node, said output current having a positive temperature coefficient.

3. A CMOS circuit for providing a bandgap reference voltage at an output that is independent of temperature, the circuit comprising:

a first transistor having first and second current carrying electrodes and a control electrode;

a second transistor having first and second current carrying electrodes and a control electrode, said second current carrying electrode of said second transistor coupled to said second current carrying electrode of said first transistor;

CMOS parasitic PN junction means for generating a delta voltage between said control electrodes of said first and second transistors, said delta voltage having a positive temperature coefficient;

a current source coupled between said second current carrying electrode of said first transistor and a first supply voltage terminal;

a third transistor having first and second current carrying electrodes and a control electrode, said first current carrying electrode and said control electrode of said third transistor coupled to said first current carrying electrode of said first transistor, said second current carrying electrode of said third transistor coupled to a second supply voltage terminal;

a fourth transistor having first and second current carrying electrodes and a control electrode, said first current carrying electrode and said control electrode of said fourth transistor coupled to said first current carrying electrode of said second transistor, said second current carrying electrode of said fourth transistor coupled to said second supply voltage terminal;

a fifth transistor having first and second current carrying electrodes and a control electrode, said second current carrying electrode of said fifth transistor coupled to said second supply voltage terminal, said control electrode of said fifth transistor coupled to said first current carrying electrode of said first transistor;

a sixth transistor having first and second current carrying electrodes and a control electrode, said second current carrying electrode of said sixth transistor coupled to said second supply voltage terminal, said control electrode of said sixth transistor coupled to said first current carrying electrode of said second transistor;

a seventh transistor having first and second current carrying electrodes and a control electrode, said first current carrying and control electrodes of said seventh transistor coupled to said first current electrode of said fifth transistor, said second current carrying electrode of said seventh transistor coupled to said first supply voltage terminal;

an eighth transistor having first and second current carrying electrodes and a control electrode, said first current carrying electrode of said eighth transistor coupled to said first current electrode of said sixth transistor and to the output of the CMOS circuit, said control electrode of said eighth transistor coupled to said first current carrying electrode of said seventh transistor, said second current carrying electrode of said eighth transistor coupled to said first supply voltage terminal;

a resistor having first and second terminals, said first terminal of said resistor coupled to the output of the CMOS circuit, said resistor having a voltage appearing thereacross having a positive temperature coefficient; and a parasitic PN junction having a negative temperature coefficient and first and second terminals, said first terminal of said parasitic PN junction coupled to said second terminal of said resistor, said second terminal of said parasitic PN junction coupled to said first supply voltage terminal.

4. A CMOS circuit for providing a bandgap reference voltage at an output that is independent of temperature, the circuit comprising:

CMOS parasitic P-N junction means for generating a delta voltage having a positive temperature coefficient;

CMOS differential amplifying means responsive to said delta voltage for providing differential currents;

summing means responsive to said differential currents for providing a resulting current at an output of said summing means, said current having a positive temperature coefficient;

a resistor element having first and second terminals, said first terminal of said resistor element coupled to said output of said CMOS summing means, said resistor element having a voltage appearing thereacross having a positive temperature coefficient; and a semiconductor device, the semiconductor device having a P-N junctions, a negative temperature coefficient, and first and second terminals, said first terminal of said semiconductor device coupled to said second terminal of said resistor element, said second terminal of said semiconductor device coupled to a first supply voltage terminal, said resistor element and said semiconductor device cooperating with said current having a positive temperature coefficient to provide a bandgap voltage that is substantially independent of temperature variations.

5. The circuit according to claim 4, wherein said resistor element is a MOS transistor such that a voltage appearing across said transistor and said semiconductor device is a bandgap voltage that is substantially independent of temperature and power supply variations, said MOS transistor having first and second current carrying electrodes and a control electrode, said first current carrying electrode coupled to said output of said CMOS summing means and serving as the first terminal of said resistor element, said second current carrying electrode coupled to said semiconductor device and serving as the second terminal of said resistor element, and said control electrode coupled to a second power supply terminal.

* * * * *